US011393610B2

(12) United States Patent
Hess

(10) Patent No.: US 11,393,610 B2
(45) Date of Patent: Jul. 19, 2022

(54) ETHERNET CABLE CROSS-FILLER WITH NOTCHES

(71) Applicant: Berk-Tek LLC, New Holland, PA (US)

(72) Inventor: Bradley G. Hess, Sinking Spring, PA (US)

(73) Assignee: Berk-Tek LLC, New Holland, PA (US)

( * ) Notice: Subject to any disclaimer, the term of this patent is extended or adjusted under 35 U.S.C. 154(b) by 0 days.

(21) Appl. No.: 16/997,527

(22) Filed: Aug. 19, 2020

(65) Prior Publication Data

US 2022/0059256 A1 Feb. 24, 2022

(51) Int. Cl.
*H01B 11/04* (2006.01)
*H01B 11/08* (2006.01)

(52) U.S. Cl.
CPC ..... *H01B 11/04* (2013.01); *H01B 11/08* (2013.01)

(58) Field of Classification Search
CPC ..... H01B 11/04; H01B 11/06; H01B 11/08; H01B 11/10
USPC ..... 174/110 R, 113 R, 113 C, 113 AS, 115, 174/116
See application file for complete search history.

(56) References Cited

U.S. PATENT DOCUMENTS

| | | | | |
|---|---|---|---|---|
| 6,236,789 | B1 | 5/2001 | Fitz | |
| 6,687,437 | B1 | 2/2004 | Starnes et al. | |
| 6,934,426 | B2 | 8/2005 | Rich et al. | |
| 7,276,664 | B2 | 10/2007 | Gagnon | |
| 7,432,447 | B2 | 10/2008 | Glew | |
| 7,696,438 | B2 * | 4/2010 | Clark | H01B 7/40 174/113 R |
| 9,316,801 | B1 | 4/2016 | Kithuka | |
| 9,424,964 | B1 * | 8/2016 | Kithuka | H01B 11/1008 |
| 9,472,322 | B2 | 10/2016 | Congdon, II et al. | |
| 9,824,794 | B1 | 11/2017 | McNutt | |
| 9,922,753 | B1 | 3/2018 | Cook | |
| 10,068,685 | B1 * | 9/2018 | Cook | H01B 11/04 |
| 10,210,968 | B1 | 2/2019 | Cook | |
| 10,276,281 | B1 * | 4/2019 | Cook | H01B 11/06 |
| 10,388,434 | B1 | 8/2019 | Gebs | |
| 10,438,726 | B1 | 10/2019 | Cook et al. | |
| 2003/0205402 | A1 | 11/2003 | Koyasu et al. | |
| 2004/0055781 | A1 * | 3/2004 | Cornibert | H01B 11/06 174/135 |
| 2005/0006132 | A1 | 1/2005 | Clark | |

(Continued)

FOREIGN PATENT DOCUMENTS

| | | |
|---|---|---|
| CN | 205751694 | 11/2016 |
| EP | 2270565 | 1/2011 |

(Continued)

OTHER PUBLICATIONS

International Search Report dated Nov. 10, 2021.
International Searching Authority dated Nov. 11, 2021.

*Primary Examiner* — William H. Mayo, III
(74) *Attorney, Agent, or Firm* — Sofer & Haroun, LLP

(57) ABSTRACT

A cross filler for arrangement within a LAN cable has a plurality of twisted pair conductors. The cross filler has a body and a plurality of radially extending arms from a center point. Each of the arms has a plurality of spaced apart notches cut into the arms, the notches spaced apart along the length of the arms. Each of the notches are dimensioned allowing bending of the LAN cable without physical breakdown of the cross filler.

12 Claims, 4 Drawing Sheets

(56) References Cited

U.S. PATENT DOCUMENTS

| | | | | |
|---|---|---|---|---|
| 2006/0237220 | A1* | 10/2006 | Leyendecker ..... | H01B 11/002<br>174/113 R |
| 2012/0045186 | A1 | 2/2012 | Wessels, Jr. et al. | |
| 2014/0241677 | A1 | 8/2014 | Sutehall et al. | |
| 2015/0117825 | A1 | 4/2015 | Burke et al. | |
| 2019/0164669 | A1 | 5/2019 | Glew | |

FOREIGN PATENT DOCUMENTS

| | | |
|---|---|---|
| GB | 2368404 | 5/2002 |
| WO | 2006/025812 | 3/2006 |
| WO | 2016073862 | 5/2016 |

* cited by examiner

ETHERNET CABLE CROSS-FILLER WITH NOTCHES

BACKGROUND

Field of the Invention

This invention relates to LAN cables. More particularly, the present invention relates to an improved cross filler construction for separating the pairs within a LAN cable.

Description of Related Art

LAN (Local Area Network) cables are common communication cables that are typically constructed of eight copper conductor wires in the form of four twisted pairs within a jacket. Owing to increases in signal throughput the electrical and communication performance of such cables is under an ever-increasing demand. There are several ways to improve the electrical performance of such cables including varied pair placement, shielding and other techniques.

One such component typically added to LAN cables is a cross filler which is a cross shaped extruded polymer that physically separates the four pairs within the jacket from one another. The purpose of the cross filler is to reduce the internal cross talk between the pairs within the cable by simply keeping a physical distance barrier between the pairs along the length of the cable. Prior art FIG. 1 shows a basic cross filler in a LAN cable and FIG. 2 shows the same cross filler in perspective view.

Such cross fillers may be used on their own or in combination with other LAN cable materials (i.e. shields) etc. . . . , to eventually meet the desired electrical characteristics. However, apart from such electrical characteristics there is always the concern that the added components will interfere with meeting the required physical requirements of the cable. For example, an exemplary industry standard is TIA 568.2-D that requires a bend radius of 4× cable OD (outside Diameter) for UTP (Unshielded Twisted Pair LAN cables) and 8× cable OD for screened horizontal cable constructions.

Another of the most basic of the physical requirements/demands is that the cable and its components are made as small and light as possible, and using the least amount of material in order to reduce costs. Also, bending, flexing, fire/smoke safety standards etc. . . . favor a smaller and simpler construction for LAN cables as added materials increase fuel for fire and otherwise make such LAN cables heavier and more costly. Additionally, stiff cables cause installation problems because they are more likely to get tangled and kinked when being pulled from a box and they are likewise more difficult to pull through conduits.

In prior art solutions, to address the issue of flexibility, the use of softer materials may help. Likewise, changing the design parameters such as twist lay length or eliminating or reducing the size of the cross filler can also improve flexibility. However, these solutions have tradeoffs: softer materials may not perform as well in flame tests, may cost more, or may have degraded electrical attributes. Changing the design parameters can also negatively impact the electrical performance of the cable or increase the cost.

OBJECTS AND SUMMARY

As such, there is a need for an improved cross filler with notches that avoids the problems with the prior art. The present invention thus looks to improve on prior art cross fillers by making them lighter and more flexible than prior art versions, while avoiding tradeoffs associated with prior art cross filler flexibility solutions. Such cables with improved flexibility are more resistant to tangles and snags when being pulled from a box. Additionally, flexible cables allow for an increased packaging density, which leads to smaller box sizes (lower packaging costs, potential for lower shipping costs, less jobsite trash for installer to deal with).

In accordance with one embodiment, this is achieved by a cross filler for arrangement within a LAN cable having a plurality of twisted pair conductors. The cross filler has a body and a plurality of radially extending arms from a center point. Each of the arms has a plurality of spaced apart notches cut into the arms, the notches spaced apart along the length of the arms. Each of the notches are dimensioned allowing bending of the LAN cable without physical breakdown of the cross filler.

BRIEF DESCRIPTION OF THE DRAWINGS

The present invention can be best understood through the following description and accompanying drawings, wherein.

DETAILED DESCRIPTION

Figure 3:
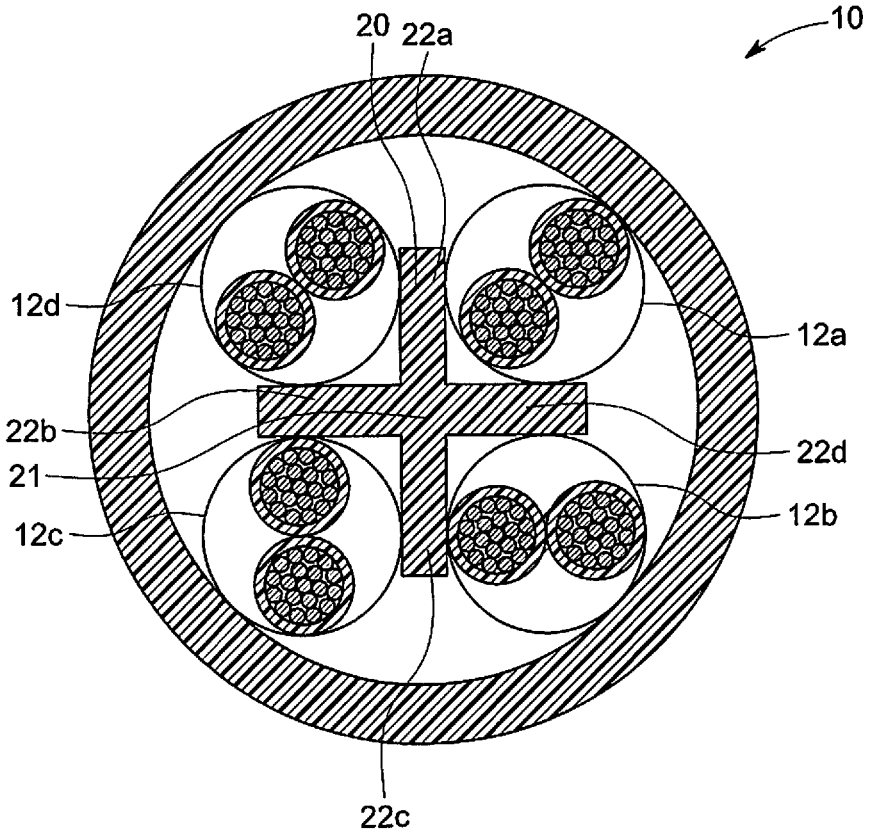
FIG. 3 illustrates a notched cross filler for a LAN cable, in accordance with one embodiment.
Figure 4:
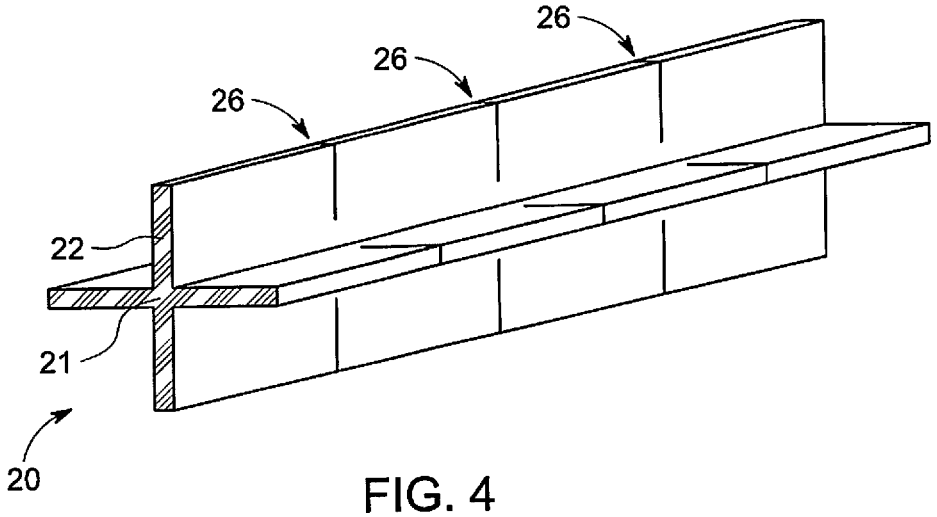
FIG. 4 illustrates the notched cross filler for a LAN cable of FIG. 3 in perspective view, in accordance with one embodiment.

In one embodiment of the present arrangement, as shown in FIGS. 3 and 4, the present arrangement includes a LAN cable 10 having four twisted pairs 12*a*-12*d* and a cross filler 20. Although the present example is shown for a four twisted pair LAN cable, the features of the present cross filler 20 described herein may be equally employed in other cable arrangements requiring internal spacing as well as LAN cables including more or fewer twisted pairs. In one example, cross filler 20 may be constructed by pressure or drawdown extrusion using a shaped die and made from any one of FRPVC (Flame retardant Poly Vinyl Chloride), FRPE (Flame retardant Poly Ethylene), FRPP (Flame retardant Poly Propylene), PE (Poly Ethylene), PP (Poly Propylene), FEP (Fluorinated Ethylene Co-Polymer), PFA (Perfluoro-alkoxy alkanes) and other polymers commonly used in the construction of LAN cables.

Figure 1:
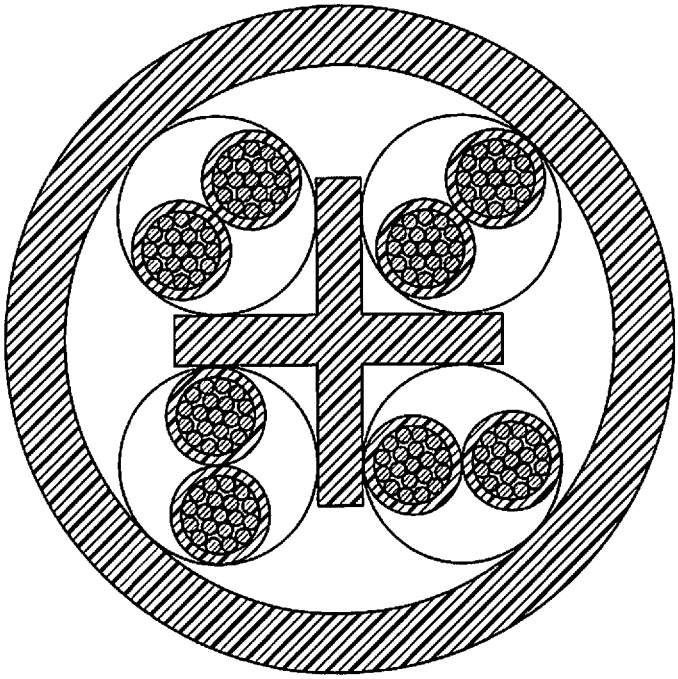
FIG. 1 (PRIOR ART)
FIG. 1 shows a prior art cross filler for a LAN cable.
Figure 2:
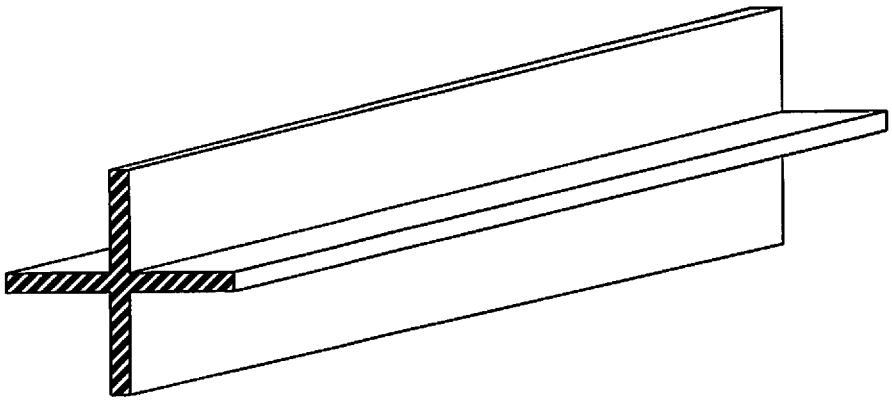
FIG. 2 (PRIOR ART)
FIG. 2 shows the prior art cross filler for a LAN cable of FIG. 1 in perspective view.
Figure 5:
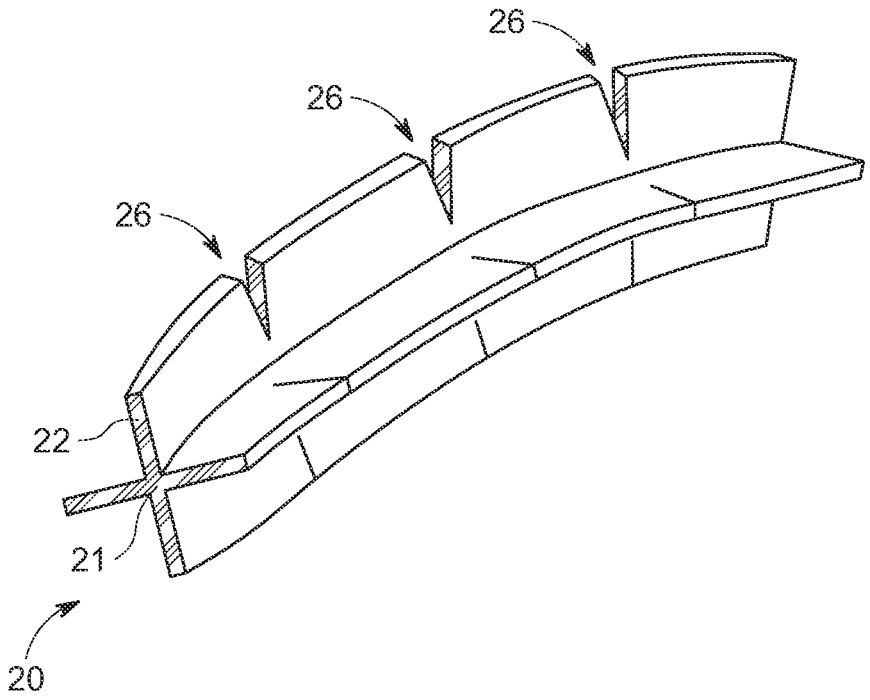
FIG. 5 illustrates the notched cross filler for a LAN cable of FIG. 3 in perspective view and in a bent position, in accordance with one embodiment.

As shown in FIGS. 3-4, cross filler 20 includes a central region 21 and four radically extending arms 22A-22D. Each of arms 22 has a given length from the center of filler 20 as well as a plurality of notches 26 or cuts disposed along the longitudinal length of the cable. Standard cross filler designs such as those in FIGS. 1 and 2 naturally resist being bent or curved because of their geometry. Adding perpendicular notches or cuts 26 to arm 22 of cross filler 10 alleviates this resistance and allows the cables to bend and flex easier as shown in FIG. 5.

In one embodiment, notches/cuts 26 can be as small as small as a width of zero (0) (in other words just a cut in the arm without removal of material). In another embodiment larger widths for notches/cuts 26 may be used as long as such cuts 26 do not allow twisted pairs 12 to pass through notches 26 and move, even partially, across arm 22 into an area for adjacent pair 12. As an example, in this embodiment with wider notches/cuts 26 would be less than ½ the lay length of the tightest lay of an adjacent pair 12. In one example, such notches 26 may be made by a rotary cutting wheel either during the extrusion operation, or during the cabling operation (or wherever cross filler 20 is being pulled into cable 10.

In one embodiment, regarding the depth of cuts/notches 26 into arms 22, a maximum depth could be set to equal to the dimension of the arm 22 (in other word down to the center point of the cross), as long as it does not go past the center axis.

Figure 6:
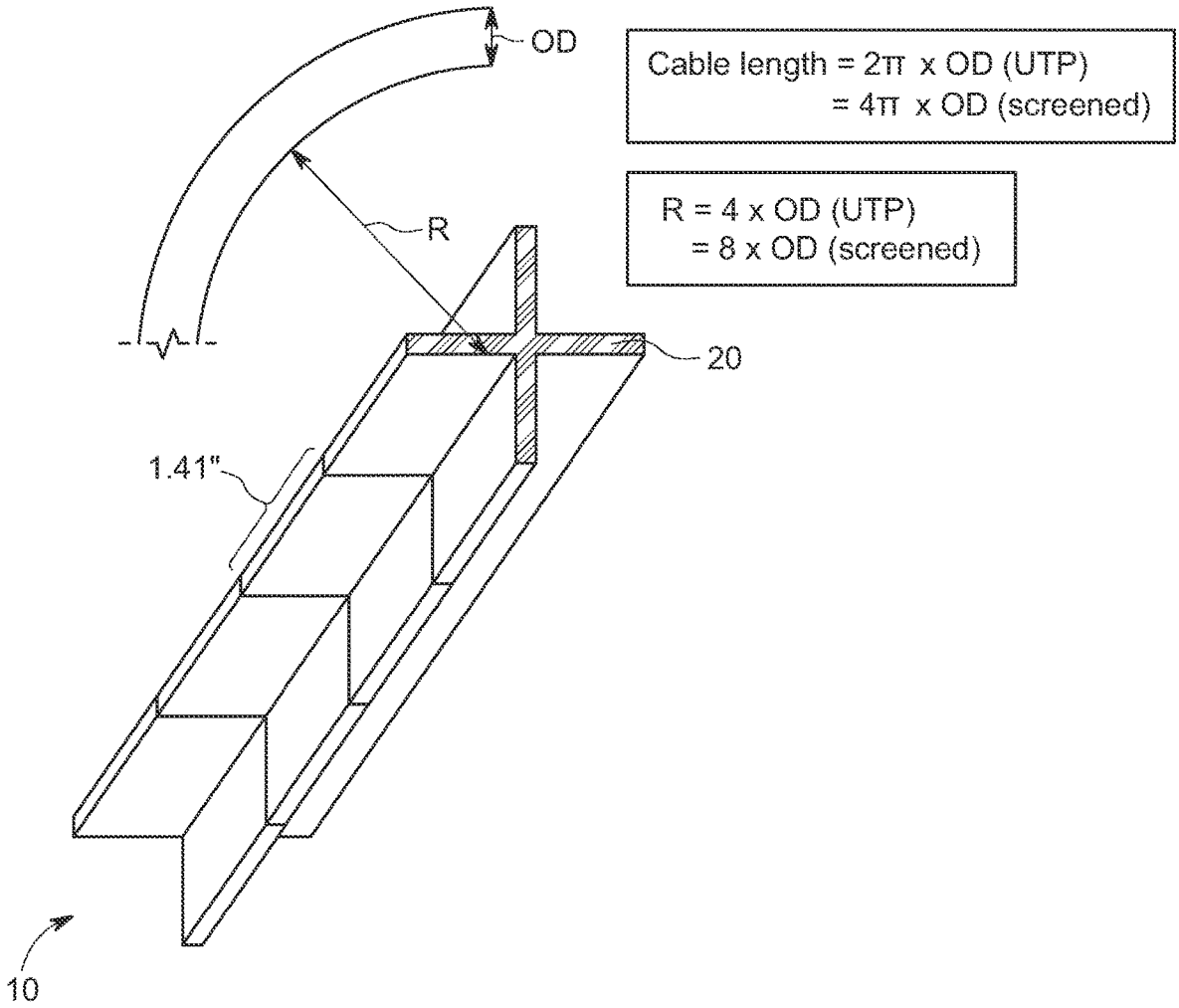
FIG. 6 illustrates the notched cross filler for a LAN Cable of FIG. 3 within a jacket of the cable and with spaced notches, in accordance with one embodiment.

Regarding the longitudinal spacing of cuts 26 along the length of arms 22 of cross filler 20, such spacing is a function of a desired bend radius of cable 10. In this case, bend radius refers to the tightest bend radius around which cable 10 can be wound without destroying the cable or resulting in an unacceptable level of attenuation relative to the desired standards of the cable construction. The tighter/smaller the bend radius the closer the spacing of notches 26. In one embodiment, as shown in FIG. 6 notches 26 are spaced for at least one (1) notch 26 per quadrant of bend radius, which equates to a maximum notch spacing of 2π×OD (Outside Diameter) for UTP (Unshielded Twisted Pair) or 4π×OD (Outside Diameter) for screened cables. For example, for a UTP cable 10 with an OD of 0.225", spacing would be at a maximum of 1.41" between successive notches 26.

In another embodiment, it is noted that a regular periodic notch 26 spacing results in a return loss spike that may modulate and create a crosstalk spike in the signals passing through pairs 12. As such, in this arrangement, aside from the basic notch spacing advised above, the actual placement is varied slightly, from notch 26 to notch 26 about an average of the calculated distance to avoid precise repetitions. For example, if the calculated spacing is 1.41" per notch 26, a first spacing may be 1.40, then a second spacing may be 1.42" for an average of 1.41".

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

The invention claimed is:

1. A cross filler for arrangement within a Local Area Network (LAN) cable having a plurality of twisted pair conductors, said cross filler comprising:

a body; and a plurality of arms radially extending from a center point, at substantially 90 degrees from one another, wherein each of said arms has a plurality of spaced apart notches cut into said arm, said notches spaced apart and disposed at the same longitudinal length along the length of said arms, wherein each of said notches are dimensioned to improve flexibility of said LAN cable and said cross-filler, without physical breakdown of said cross filler, and wherein said notches are spaced along the longitudinal length of said arms such that there is at least one (1) notch per arm, per quadrant of bend radius, equating to a maximum notch spacing of 2π times and OD (Outside Diameter) for said cable, when said cable is an UTP (Unshielded Twisted Pair) cable.

2. The cross filler as claimed in claim 1, wherein said spacing for said notches for said cable, having an OD (Outside Diameter) of 0.225" spacing would be at approximately 1.41" between successive notches.

3. The cross filler as claimed in claim 2, a placement location is varied slightly, from any one said notch to another successive notch, avoiding precise repetitions of distances between successive notches, so that an average such varied spacings is 1.41".

4. The cross filler as claimed in claim 1, wherein spacing between successive notches is varied above and below an average spacing.

5. The cross filler as claimed in claim 1, wherein said notches are cut with a width of substantially zero.

6. A cross filler for arrangement within a Local Area Network (LAN) cable having a plurality of twisted pair conductors, said cross filler comprising:

a body; and a plurality of arms radially extending from a center point, at substantially 90 degrees from one another, notches are included on said arms, dimensioned to improve flexibility of said LAN cable and said cross-filler, without physical breakdown of said cross filler, and wherein said notches are spaced along the longitudinal length of said arms such that there is at least one (1) notch per arm, per quadrant of bend radius, equating to a maximum notch spacing of 4π times and OD (Outside Diameter) for said cable, when said cable is a shielded twisted pair cable.

7. The cross filler as claimed in claim 6, wherein said spacing for said notches for said cable, having an OD (Outside Diameter) of 0.225" spacing would be at approximately 2.82" between successive notches.

8. The cross filler as claimed in claim 7, a placement location is varied slightly, from any one said notch to another successive notch, avoiding precise repetitions of distances between successive notches, so that an average such varied spacings is 2.82".

9. The cross filler as claimed in claim 6, wherein spacing between successive notches is varied above and below an average spacing.

10. The cross filler as claimed in claim 6, wherein said notches are cut with a width of substantially zero.

11. A cross filler for arrangement within a Local Area Network (LAN) cable having a plurality of twisted pair conductors, said cross filler comprising:

a body; and a plurality of arms radially extending from a center point, wherein each of said arms has a plurality of spaced apart notches cut into said arms, said notches spaced apart along the length of said arms, wherein each of said notches are dimensioned to improve flexibility of said LAN cable and said cross-filler, without physical breakdown of said cross filler, wherein said notches are cut into said arms to a depth down to said center point, and wherein said notches are cut with a width of greater than zero but a width less than ½ a lay length of one of said twisted pairs with a tightest length.

12. The cross filler as claimed in claim 11, wherein said notches are cut with a width of substantially zero.

* * * * *